US010305258B2

(12) United States Patent
Hattori et al.

(10) Patent No.: US 10,305,258 B2
(45) Date of Patent: May 28, 2019

(54) IGNITION COIL FOR INTERNAL COMBUSTION ENGINE

(71) Applicant: DENSO CORPORATION, Kariya, Aichi-pref. (JP)

(72) Inventors: Kenji Hattori, Kariya (JP); Kaori Doi, Kariya (JP); Masamichi Shibata, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/564,876

(22) PCT Filed: Apr. 7, 2016

(86) PCT No.: PCT/JP2016/061349

§ 371 (c)(1),
(2) Date: Oct. 6, 2017

(87) PCT Pub. No.: WO2016/163438

PCT Pub. Date: Oct. 13, 2016

(65) Prior Publication Data

US 2018/0109079 A1 Apr. 19, 2018

(30) Foreign Application Priority Data

Apr. 8, 2015 (JP) ..... 2015-079346

(51) Int. Cl.
*H01T 13/20* (2006.01)
*H01T 13/04* (2006.01)
(Continued)

(52) U.S. Cl.
CPC ..... *H01T 13/04* (2013.01); *F02P 13/00* (2013.01); *F02P 15/00* (2013.01); *H01F 38/12* (2013.01); *H01T 15/00* (2013.01); *H01T 13/32* (2013.01)

(58) Field of Classification Search
CPC ..... H01T 13/04; H01T 13/32; H01T 13/38; H01T 15/00; F02P 15/00; H01F 38/12
See application file for complete search history.

(56) References Cited

U.S. PATENT DOCUMENTS 5,716,223 A * 2/1998 Phillips, Jr. ..... H01T 13/06 439/125
6,358,071 B1 * 3/2002 Moga ..... H01T 13/04 439/125

(Continued)

FOREIGN PATENT DOCUMENTS

JP 9-180856 A 7/1997
JP 11-230015 8/1999

(Continued)

OTHER PUBLICATIONS

International Search Report dated Jun. 14, 2016 issued in PCT/JP2016/061349 (1 pg.).

*Primary Examiner* — Hai H Huynh
*Assistant Examiner* — Gonzalo Laguarda
(74) *Attorney, Agent, or Firm* — Nixon & Vanderhye P.C.

(57) ABSTRACT

In an ignition coil for an internal combustion engine, a spark plug is incorporated which has an insulator including an insulator head that has no corrugation. The ignition coil has a coil body part generating high voltage and a joint part, which holds therein a conducting member electrically connecting the coil body part and a spark plug. The joint part has a plug cap into which the insulator head of the spark plug is inserted and which is formed of an elastic member having a cylindrical shape. The plug cap has a close-contact part whose inner peripheral surface is closely brought into contact with an outer peripheral surface of the insulator. The close-contact part has a tip end-side close-contact part positioned at a tip end side with respect to a middle position in an axial direction, and a base end-side close-contact part (Continued)

positioned at a base end side with respect to the middle position. At least part of the base end-side close-contact part is provided with a strong strained force part that has strained force for fastening the insulator head, the strained force being stronger than strained force of all portions of the tip end-side close-contact part.

1 Claim, 8 Drawing Sheets

(51) Int. Cl.

| | |
|---|---|
| ***F02P 13/00*** | (2006.01) |
| ***F02P 15/00*** | (2006.01) |
| ***H01F 38/12*** | (2006.01) |
| ***H01T 15/00*** | (2006.01) |
| *H01T 13/32* | (2006.01) |

(56) References Cited

U.S. PATENT DOCUMENTS

| | | | | |
|---|---|---|---|---|
| 8,860,291 | B2 * | 10/2014 | L'Henoret | H01T 13/40 313/141 |
| 2007/0277795 | A1 * | 12/2007 | Satoh | F02P 13/00 123/634 |
| 2014/0020667 | A1 | 1/2014 | Ishiguro | |

FOREIGN PATENT DOCUMENTS

| | | |
|---|---|---|
| JP | 2005-190937 | 7/2005 |
| JP | 2008-21870 | 1/2008 |

* cited by examiner

IGNITION COIL FOR INTERNAL COMBUSTION ENGINE

This application is the U.S. national phase of International Application No. PCT/JP2016/061349 filed Apr. 7, 2016 which designated the U.S. and claims priority to JP Patent Application No. 2015-079346 filed Apr. 8, 2015, the entire contents of each of which are hereby incorporated by reference.

TECHNICAL FIELD

The present invention relates to an ignition coil for an internal combustion engine, for applying high voltage to spark plugs arranged in the internal combustion engine to ignite the spark plugs.

BACKGROUND ART

An ignition coil for an internal combustion engine has a coil body part generating high voltage and a joint part, which holds therein a conducting member electrically connecting the coil body part and a spark plug. The joint part of the spark plug is inserted in a plug hole of an engine head. Then, the conducting member of the ignition coil is electrically connected with the spark plug at a terminal fitting. In addition, the spark plug is attached to the engine head at a housing.

Here, a joint part of the ignition coil has a cylindrical plug cap into which an insulator of the spark plug is fitted. Patent literature 1 discloses a structure in which a plug cap is formed so that the inner peripheral surface thereof has a convexo-concave shape in the axial direction to attach a spark plug to the plug cap and detach the spark plug from the plug cap.

CITATION LIST

Patent Literature

[Patent Literature 1] JP-A-2005-190937

SUMMARY OF THE INVENTION

Technical Problem

However, the ignition coil disclosed in patent literature 1 has the following problems.

At a concave portion of the inner peripheral surface of the plug cap, the strained force for fastening an insulator is easily weakened, and a minute gap (air space) is easily formed between the portion and the insulator. If the gap is formed, discharge may be caused in the gap. Furthermore, if discharge is repeatedly caused in the gap between the plug cap and the insulator, the inner surface of the plug cap deteriorates (carbonizes). Furthermore, if the deterioration extends to the whole close-contact surface between the plug cap and the insulator in the axial direction, the insulation properties between a terminal fitting and a housing may be lowered.

To solve the above problems, it can be considered that the strained force for fastening the insulator is increased for the whole plug cap to prevent a gap between the plug cap and the insulator from being formed, thereby ensuring the insulation properties. However, a new problem arises that when the spark plug is fitted into the plug cap, or when the spark plug is extracted from the plug cap, strong force is required.

Solution to Problem

An embodiment provides an ignition coil for an internal combustion engine, the ignition coil being able to ensure insulation properties without difficulties in attaching or detaching a spark plug to or from a plug cap.

In the ignition coil for an internal combustion engine of an embodiment, a spark plug is incorporated which has an insulator including an insulator head that has no corrugation. The ignition coil has a coil body part generating high voltage and a joint part, which holds therein a conducting member electrically connecting the coil body part and a spark plug. The joint part has a plug cap into which the insulator head of the spark plug is inserted and which is formed of an elastic member having a cylindrical shape. The plug cap has a close-contact part whose inner peripheral surface is closely brought into contact with an outer peripheral surface of the insulator. The close-contact part has a tip end-side close-contact part positioned at a tip end side with respect to a middle position in an axial direction, and a base end-side close-contact part positioned at a base end side with respect to the middle position. At least part of the base end-side close-contact part is provided with a strong strained force part that has strained force for fastening the insulator head, the strained force being stronger than strained force of all portions of the tip end-side close-contact part.

DESCRIPTION OF THE EMBODIMENTS

Hereinafter, in the description of an ignition coil for an internal combustion engine, the side at which a spark plug is inserted is defined as a tip end side, and the opposite side of the tip end side is defined as a base end side.

First Embodiment

An embodiment of an ignition coil for an internal combustion engine will be described with reference to FIG. 1 to FIG. 4.

Figure 3:
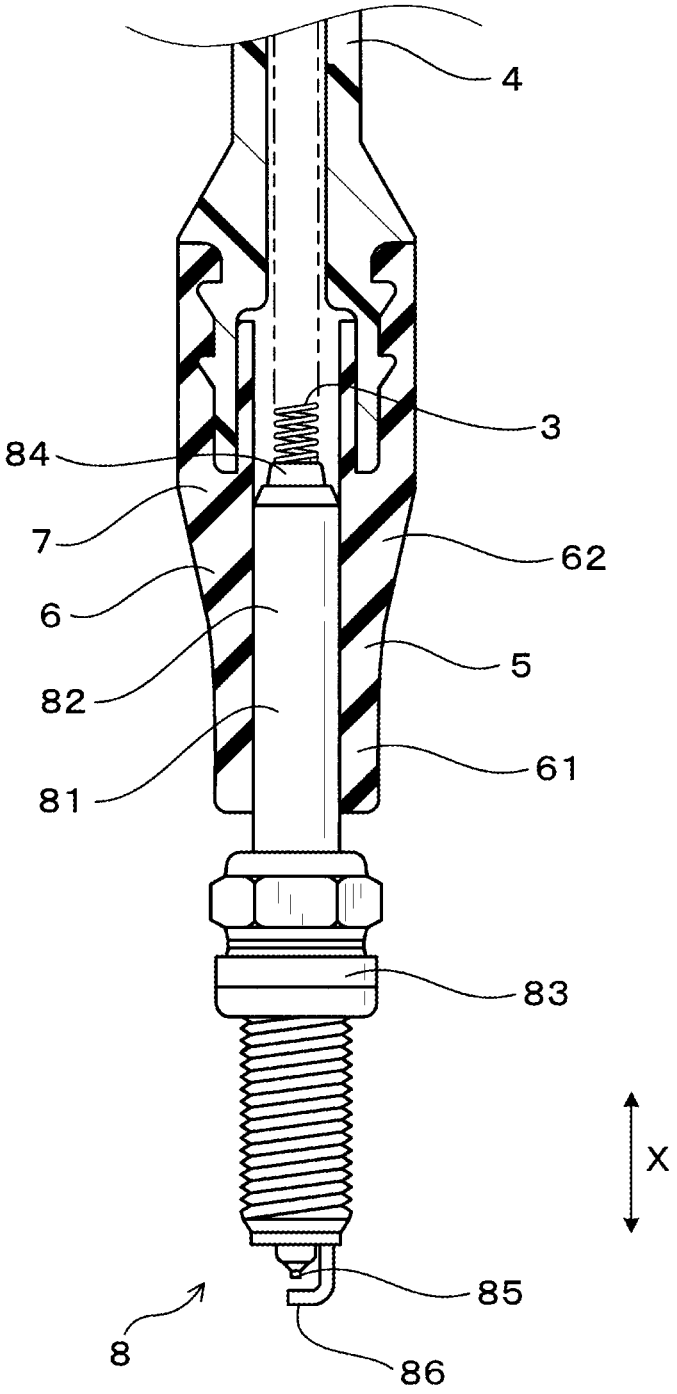
FIG. 3 is a partial cross-sectional view showing a state where a spark plug is attached to the ignition coil for an internal combustion engine according to the first embodiment.

As shown in FIG. 3, into an ignition coil 1 for an internal combustion engine, a spark plug 8 is incorporated which has an insulator 81 including an insulator head 82 that has no corrugation.

Figure 1:
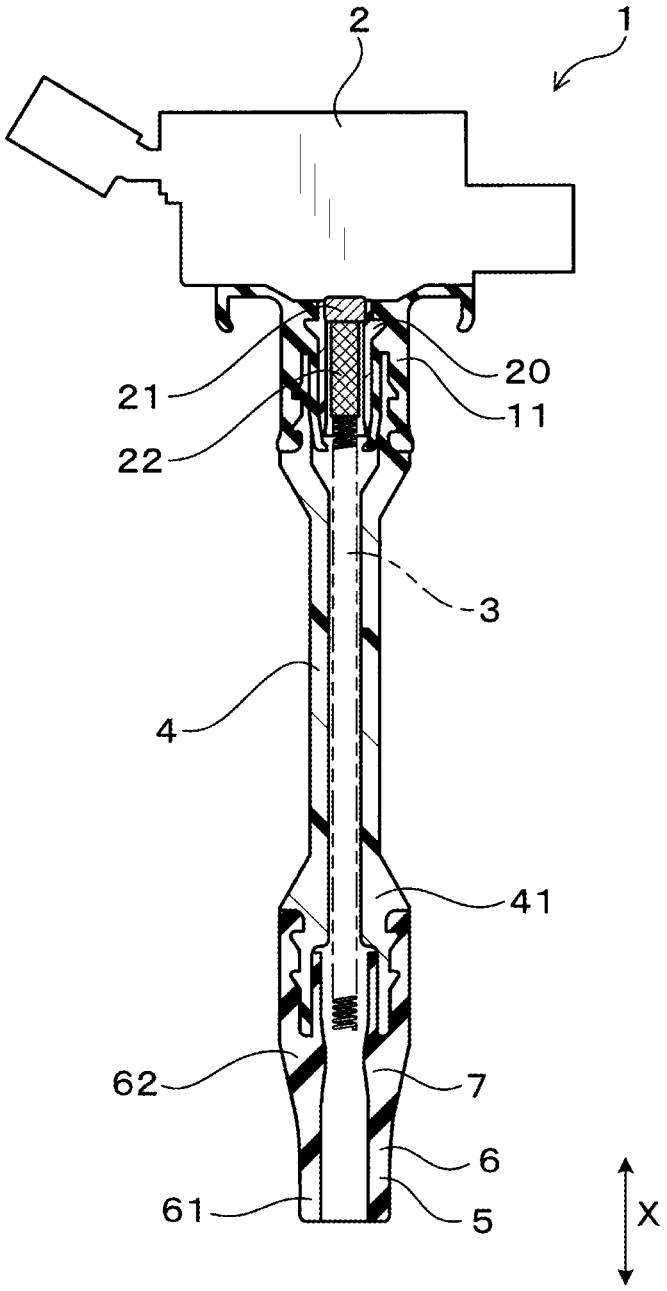
FIG. 1 is a partial cross-sectional view of an ignition coil for an internal combustion engine according to a first embodiment.
Figure 2:
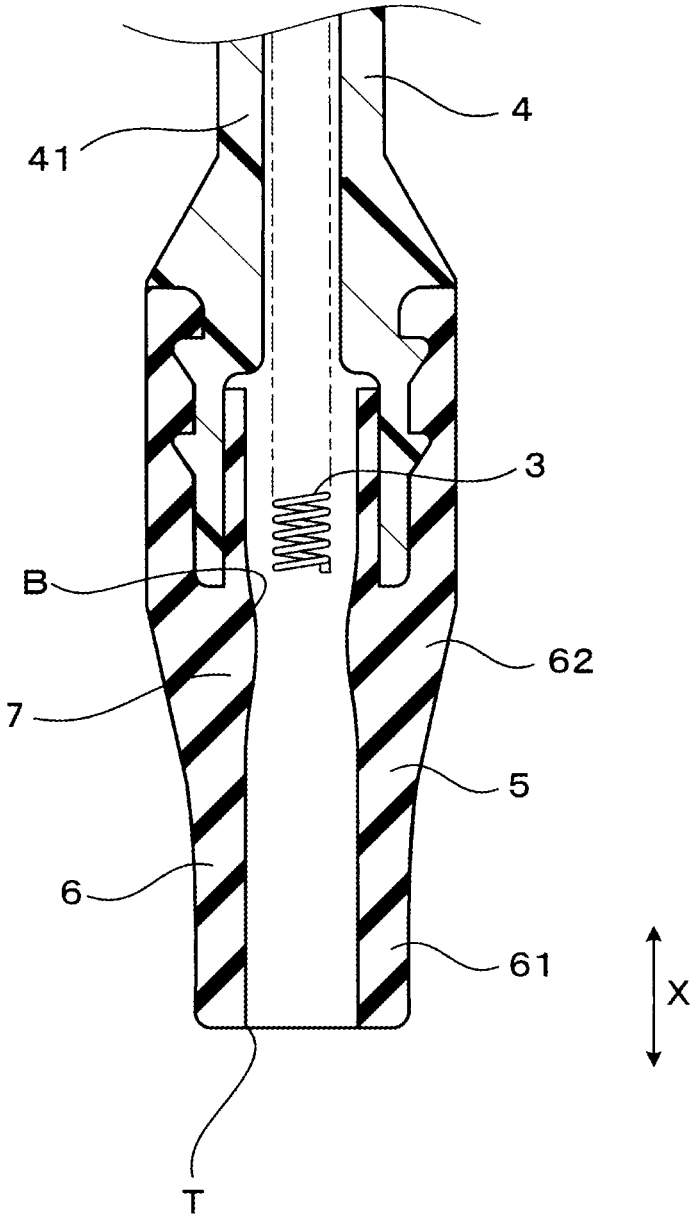
FIG. 2 is an enlarged sectional view of the periphery of a plug cap according to the first embodiment.

As shown in FIG. 1 to FIG. 3, the ignition coil 1 for the internal combustion engine has a coil body part 2 that generates high voltage and a joint part 4 that holds therein a conducting member 3 electrically connecting the coil body part 2 and a spark plug 8. As shown in FIG. 3, the joint part 4 has a plug cap 5 into which the insulator head 82 of the spark plug 8 is inserted and which is formed of an elastic member having a cylindrical shape. As shown in FIG. 2, the plug cap 5 has a close-contact part 6 whose inner peripheral surface is closely brought into contact with the outer peripheral surface of the insulator 81. The close-contact part 6 has a tip end-side close-contact part 61 positioned at the tip end side with respect to the middle position in the axial direction X, and a base end-side close-contact part 62 positioned at the base end side with respect to the middle position. At least part of the base end-side close-contact part 62 is provided with a strong strained force part 7 that has strained force for fastening the insulator head 82 (hereinafter, simply referred to as strained force), the strained force of the strong strained force part 7 being stronger than that of all portions of the tip end-side close-contact part 61.

The coil body part 2 has a primary coil and a secondary coil that are magnetically coupled to each other. As shown in FIG. 1, the coil body part 2 has a high voltage tower part 20 formed so as to project in the axial direction X. The high voltage tower part 20 holds therein a high voltage output terminal 21 that outputs high voltage generated from the coil body part 2, and a resistive element 22. The end of the resistive element 22 comes into contact with the conducting member 3 in the joint part 4.

The joint part 4 has a cylindrical pole joint 41 and the plug cap 5 fitted to the pole joint 41 at the end part of the pole joint 41. Between the high voltage tower part 20 and the pole joint 41, a connection seal member 11 is provided which connects the high voltage tower part 20 and the pole joint 41 and seals therebetween. For example, the pole joint 41 is formed of resin having insulation properties, and the plug cap 5 is formed of rubber.

As shown in FIG. 1 and FIG. 2, the plug cap 5 has a cylindrical shape. The base end part of the plug cap 5 is fitted to the pole joint 41. As shown in FIG. 3, the insulator head 82 of the spark plug 8 is fitted into the inside of the plug cap 5 from the tip end side thereof.

Figure 4:
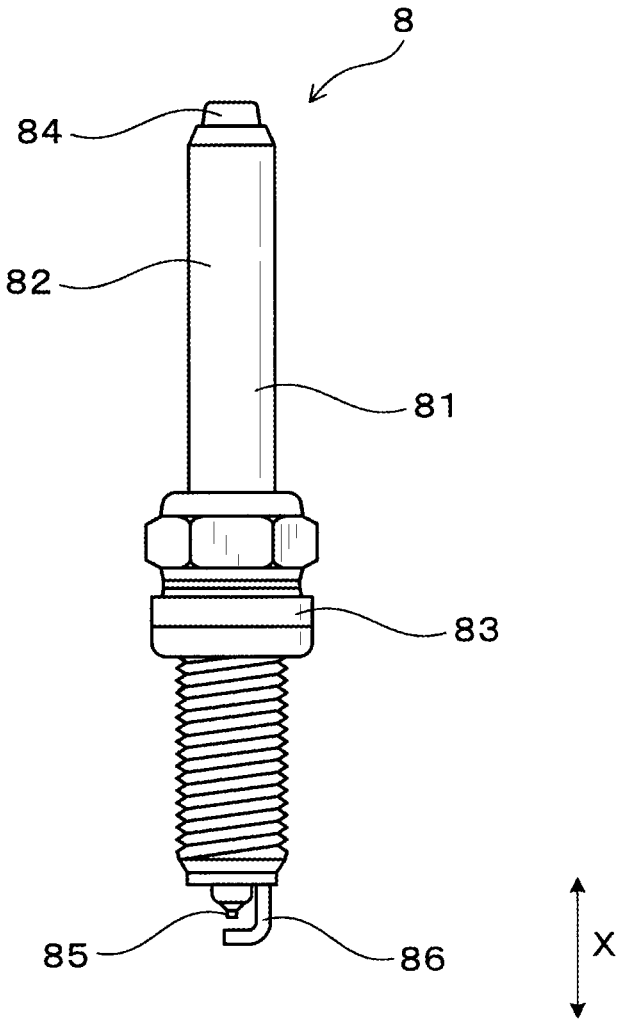
FIG. 4 is a front view of the spark plug according to the first embodiment.

As shown in FIG. 3 and FIG. 4, the spark plug 8, into which the plug cap 5 is fitted, has the insulator 81, a housing 83 holding the insulator 81, a terminal fitting 84 held inside the insulator 81 so that the base end part thereof projects, a center electrode 85 and an earth electrode 86 for generating spark discharge. The terminal fitting 84 is connected to the conducting member 3 in the joint part 4, thereby being electrically connected to the ignition coil 1. The insulator 81 is held by the housing 83 in the state where the insulator head 82 is exposed to the base end side from the housing 83. The insulator head 82 has an external diameter constant along the axial direction X. That is, the outer peripheral surface of the insulator head 82 is formed just along the axial direction X, and has a shape having no corrugation. As shown in FIG. 3, in the spark plug 8, the insulator head 82 is fitted into the plug cap 5 so that the outer peripheral surface of the insulator head 82 is closely brought into contact with the inner peripheral surface of the close-contact part 6.

As shown in FIG. 2, the close-contact part 6 has the tip end-side close-contact part 61 and the base end-side close-contact part 62. The base end-side close-contact part 62 is provided with the strong strained force part 7. The strong strained force part 7 is formed by making the thickness thereof in the radial direction larger than that of the tip end-side close-contact part 61. In the present embodiment, the strong strained force part 7 is formed so that the thickness thereof in the radial direction becomes larger than that of the tip end-side close-contact part 61 by swelling the inner peripheral surface of the plug cap 5 inward. It is noted that although the close-contact part 6 is divided into the tip end-side close-contact part 61 and the base end-side close-contact part 62, this configuration is made for the sake of convenience to describe the close-contact part 6 by dividing it into a tip end-side portion and a base end-side portion. In addition, for the sake of convenience, in FIG. 2, the end of the close-contact part 6 is denoted by a sign T, and the base end of the close-contact part 6 is denoted by a sign B.

As shown in FIG. 2, the inner peripheral surface of the strong strained force part 7 is formed so as to gradually swell inward in the radial direction. That is, the strong strained force part 7 is formed so that the amount of inward projection in the radial direction gradually increases along the axial direction X and toward the center. In the axial direction X, the strong strained force part 7 has a length equal to or more than half of the length of the base end-side close-contact part 62. The strong strained force part 7 is formed on the whole circumference of the inner peripheral surface of the base end-side close-contact part 62.

The tip end-side close-contact part 61 has an internal diameter constant in the axial direction X. The strong strained force part 7 of the base end-side close-contact part 62 has an internal diameter smaller than that of the tip end-side close-contact part 61. In addition, the internal diameter of the close-contact part 6 is smaller than the external diameter of the insulator head 82. Hence, in the state where the spark plug 8 is fitted into the plug cap 5, the close-contact part 6 closely contacts the insulator head 82 and strains the insulator head 82. In addition, the strong strained force part 7 has strained force stronger than that of the tip end-side close-contact part 61.

It is noted that, as shown in FIG. 2, the strong strained force part 7 has a shape swelling to the inner peripheral side in a so-called free state in which the spark plug 8 is not fitted into the plug cap 5. However, as shown in FIG. 3, in the state where the spark plug 8 is fitted, the swelling is not present.

Next, effects of the above embodiment will be described.

In the ignition coil 1 for an internal combustion engine, at least part of the base-end side close-contact part 62 is provided with the strong strained force part 7. Hence, sliding frictional force is easily reduced when the spark plug 8 is attached to or detached from the plug cap 5. That is, the spark plug 8 can be fitted into the plug cap 5 with relatively weak force at least to the middle position of the close-contact part 6 in the axial direction X. In addition, the spark plug 8 can be removed from the plug cap 5 with relatively weak force at least from the middle position of the close-contact part 6 in the axial direction X.

In addition, at least part of the base end-side close-contact part 62 is provided with the strong strained force part 7. Hence, a gap can reliably be prevented from being generated at least between the strong strained force part 7 and the insulator head 82, whereby discharge can reliably be prevented from being caused between the strong strained force part 7 and the insulator head 82. As a result, the insulation properties can reliably be ensured between the tip end side and the base end side of the close-contact part 6.

In addition, the strong strained force part 7 is formed by making the thickness thereof in the radial direction larger than the thickness of the tip end-side close-contact part 61. Hence the strong strained force part 7 can be easily formed.

In addition, the strong strained force part 7 is formed by swelling the inner peripheral surface of the plug cap 5 inward so that thickness thereof in the radial direction becomes larger than the thickness of the tip end-side close-contact part 61. Hence, the strained force of the strong strained force part 7 is easily ensured.

As described above, according to the present embodiment, an ignition coil for an internal combustion engine can be provided, the ignition coil being able to ensure insulation properties without difficulties in attaching or detaching a spark plug to or from a plug cap.

(Example of Experiment)

The present example evaluates insulation properties between the tip end side and the base end side of the close-contact part 6 obtained when the position where the strong strained force part of the close-contact part 6 is formed is variously changed in the axial direction X.

In the present example, while the basic configuration is similar to that of the first embodiment, six plug caps, in which the position where the strong strained force part is formed was variously changed in the axial direction X, and a plug cap that has no strong strained force part were prepared. The respective six plug caps had the strong strained force parts whose middle positions in the axial direction X are distanced from the end of the close-contact part 6 by 5 mm, 10 mm, 15 mm, 20 mm, 25 mm, and 30 mm. The length of the close-contact part 6 in the axial direction X of each of the plug caps was 32 mm. In addition, each of the plug caps was left for 120 hours at temperature of 180 C°, thereby being deteriorated.

Then, the spark plugs 8 described in the first embodiment were fitted into the ignition coils 1 including the respective plug caps 5, and the plug caps 5 and the spark plugs 8 were immersed in an aqueous solution including 5% by weight of salt. In this condition, a predetermined voltage was applied between the center electrode 85 and the earth electrode 86 at a frequency of 50 Hz for 20 hours. During that time, it was observed whether creeping discharge was caused between the tip end side and the base end side of the close-contact part 6. The presence or absence of the creeping discharge was determined by confirming a voltage waveform between the ignition coil and the spark plug.

The above test was performed with the applied voltage variously changed. Then, regarding the configurations using the plug cap having the strong strained force part, the minimum voltages (flashover generated voltage) at which creeping discharge was caused are plotted on a graph shown in FIG. 5 to illustrate an approximate curve. In addition, the flashover generated voltage obtained when a plug cap having no strong strained force part was used was 42 kV. In the graph shown in FIG. 5, the horizontal axis indicates the length between the end of the close-contact part 6 and the end of the strong strained force part. The vertical axis indicates flashover generated voltage.

Figure 5:
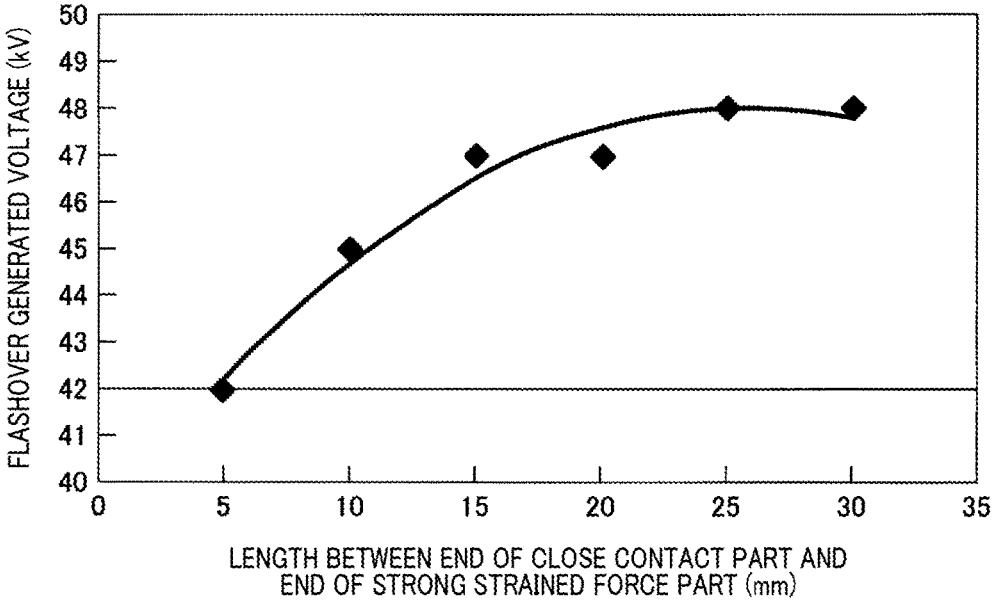
FIG. 5 is a diagram showing a relationship between length between an end of a close-contact part and an end of a fastening part, and flashover generated voltage, according to an example of experiment.

As can be understood from FIG. 5, as the position of the strong strained force part 7 is closer to the base end part from the end of the close-contact part 6, the flashover generated voltage tends to increase. That is, as the position of the strong strained force part 7 is closer to the base end part from the end of the close-contact part 6, the insulation properties between the end part and the base end part of the close-contact part 6 tends to improve. In addition, the configuration, in which the distance from the end of the close-contact part to the position of the strong strained force part 7 at the base end side is 10 mm or more, has a high flashover generated voltage compared with the configuration having no strained force part. In addition, the configuration, in which the distance from the end of the close-contact part 6 to the position of the strong strained force part 7 at the base end side is 15 mm or more, has a sufficiently high flashover generated voltage. Hence, if the strong strained force part 7 is positioned at the base end side with respect to the middle position of the close-contact part 6 (the position distanced from the end of the close-contact part 6 by 16 mm) in the axial direction X, the flashover generated voltage can be sufficiently high.

From the above results, it can be understood that the ignition coil 1 having the plug cap 5, which is provided with the strong strained force part 7 at at least part of the base end-side close-contact part 62, has good insulation properties between the tip end side and the base end side of the close-contact part 6.

Second Embodiment

Figure 6:
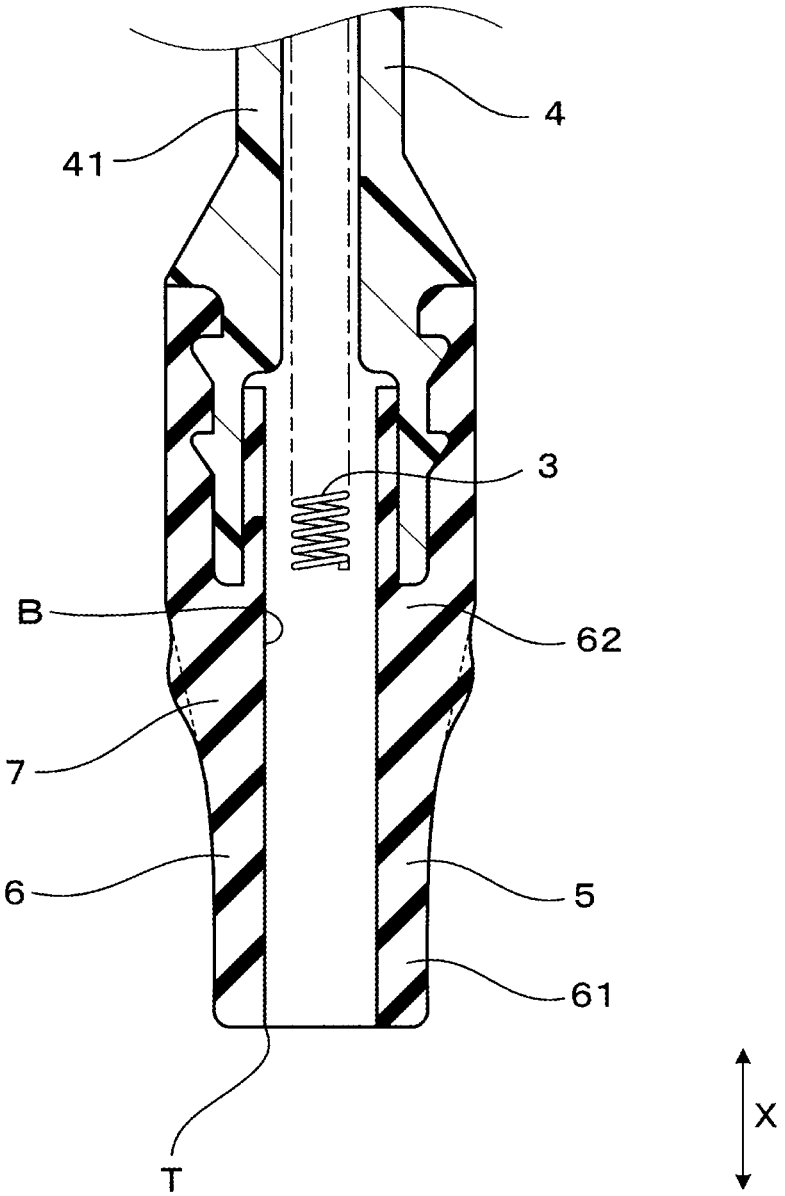
FIG. 6 is an enlarged sectional view of the periphery of a plug cap according to a second embodiment.

In the present embodiment, as shown in FIG. 6, the strong strained force part 7 is formed so that the thickness thereof in the radial direction becomes larger than that of the tip end-side close-contact part 61 by swelling the outer peripheral surface of the plug cap 5 outward. Hence, the strained force of the strong strained force part 7 is stronger than the strained force of the tip end-side close-contact part 61. It is noted that, in FIG. 6, the outer peripheral surface of the plug cap that does not have the strong strained force part 7 is indicated by broken lines.

The outer peripheral surface of the strong strained force part 7 is formed so as to gradually swell outward in the radial direction. That is, the strong strained force part 7 is formed so that the amount of outward projection in the radial direction gradually increases along the axial direction X and toward the center. The strong strained force part 7 is formed on the whole circumference of the outer peripheral surface of the base end-side close-contact part 62. In the present embodiment, the internal diameter of the base end-side close-contact part 62 is the same as the internal diameter of the tip end-side close-contact part 61. That is, in the present embodiment, the internal diameter of the close-contact part 6 is constant totally along the axial direction X.

Other configurations are similar to those of the first embodiment. It is noted that the same signs used in the present embodiment and the drawings concerning the present embodiment as the signs used in the first embodiment indicate components and the like similar to those of the first embodiment unless otherwise stated.

According to the present embodiment, since the thickness of the strong strained force part 7 in the radial direction can be increased, elastic force of the strong strained force part 7 in the radial direction can be strong. Hence, the strained force of the strong strained force part 7 can be strong, whereby the insulation properties can reliably be ensured between the tip end side and the base end side of the close-contact part 6.

Additionally, the present embodiment has effects similar to those of the first embodiment.

Third Embodiment

Figure 7:
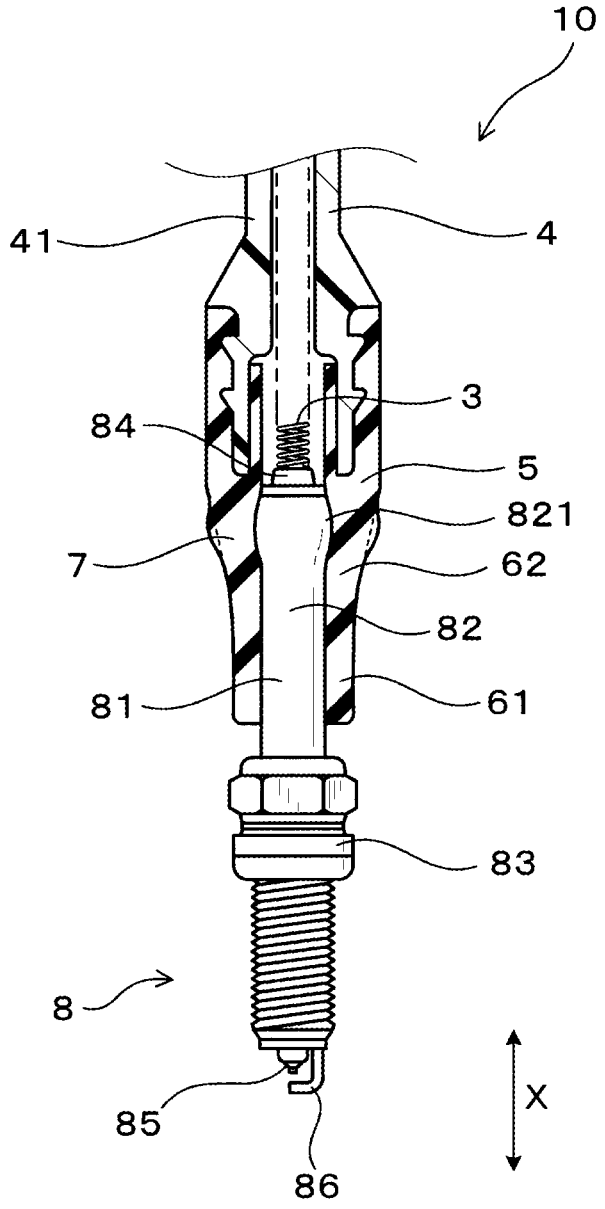
FIG. 7 is a partial cross-sectional view of an attachment structure according to a third embodiment.
Figure 8:
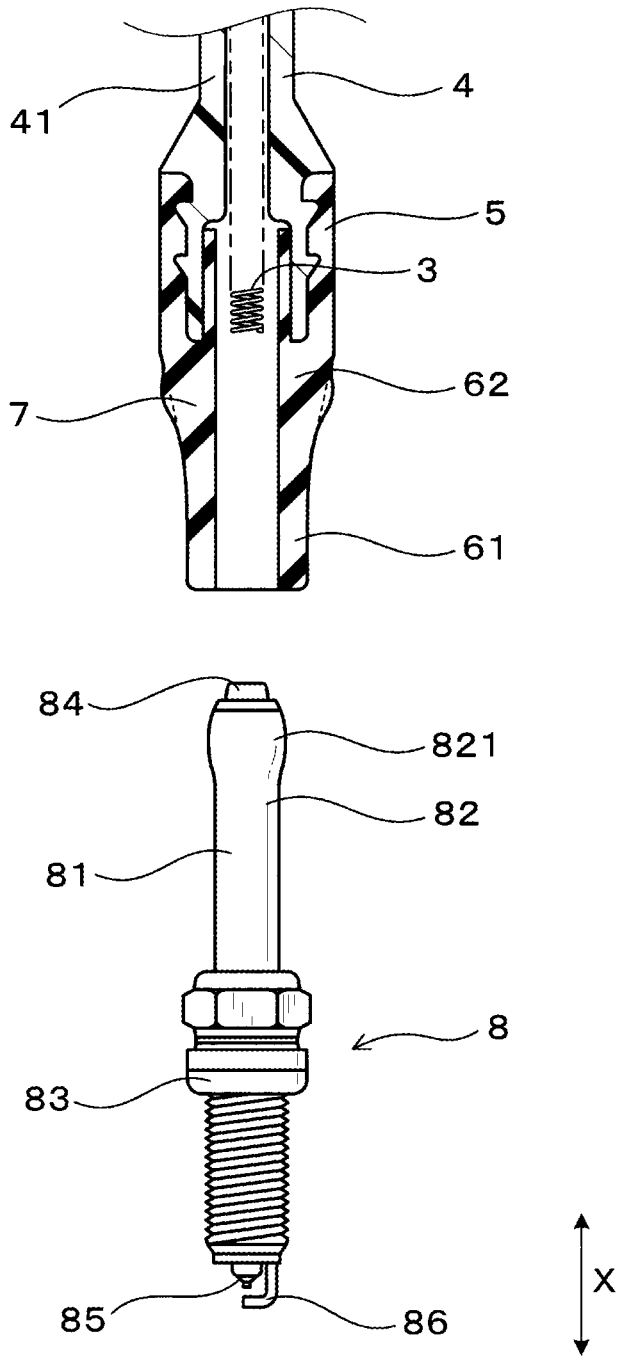
FIG. 8 is an exploded partial cross-sectional view of the attachment structure according to the third embodiment.

In the present embodiment, as shown in FIG. 7 and FIG. 8, an attachment structure 10 is formed in which the spark plug 8 is fitted into the ignition coil 1 of the second embodiment. In addition, in the spark plug 8 described in the first embodiment, the shape of the insulator head 82 is modified. That is, the insulator head 82 has an insulator swelling part 821 whose outer peripheral surface swells outward. The outer peripheral surface of the insulator swelling part 821 is formed so as to gradually swell outward. In the state where the spark plug 8 is fitted into the plug cap 5 of the ignition coil 1, the insulator swelling part 821 is formed at the same position in the axial direction X as the position where the strong strained force part 7 of the plug cap 5 is formed. The insulator swelling part 821 is formed on the whole circumference of the insulator 81.

Other configurations are similar to those of the second embodiment. It is noted that the same signs used in the present embodiment and the drawings concerning the present embodiment as the signs used in the second embodiment indicate components and the like similar to those of the second embodiment unless otherwise stated.

In the present embodiment, in the state where the spark plug 8 is fitted into the plug cap 5 of the ignition coil 1, the insulator swelling part 821 is arranged at the same position in the axial direction X as that of the strong strained force part 7. Hence, the strained force of the strong strained force part 7 can be stronger, whereby the insulation properties can be further ensured between the tip end side and the base end side of the close-contact part 6.

Additionally, the present embodiment has effects similar to those of the first embodiment.

In the ignition coil (1) for an internal combustion engine of the above embodiment, a spark plug (8) is incorporated which has an insulator (81) including an insulator head (82) that has no corrugation. The ignition coil (1) has a coil body part (2) generating high voltage and a joint part (4), which holds therein a conducting member (3) electrically connecting the coil body part and a spark plug (8). The joint part (4) has a plug cap (5) into which the insulator head (82) of the spark plug (8) is inserted and which is formed of an elastic member having a cylindrical shape. The plug cap (5) has a close-contact part (6) whose inner peripheral surface is closely brought into contact with an outer peripheral surface of the insulator (81). The close-contact part (6) has a tip end-side close-contact part (61) positioned at a tip end side with respect to a middle position in an axial direction (X), and a base end-side close-contact part (62) positioned at a base end side with respect to the middle position. At least part of the base end-side close-contact part (62) is provided with a strong strained force part (7) that has strained force for fastening the insulator head (82), the strained force being stronger than strained force of all portions of the tip end-side close-contact part (61).

In the above ignition coil for an internal combustion engine, at least part of the base-end side close-contact part is provided with the strong strained force part. Hence, sliding frictional force is easily reduced when the spark plug is attached to or detached from the plug cap. That is, the spark plug can be fitted into the plug cap with relatively weak force at least to the middle position of the close-contact part in the axial direction. In addition, the spark plug can be removed from the plug cap with relatively weak force at least from the middle position of the close-contact part in the axial direction.

In addition, at least part of the base end-side close-contact part is provided with the strong strained force part. Hence, a gap can reliably be prevented from being generated at least between the strong strained force part and the insulator head, whereby discharge can reliably be prevented from being caused between the strong strained force part and the insulator head. As a result, the insulation properties can reliably be ensured between the tip end side and the base end side of the close-contact part.

As described above, the embodiment can provide an ignition coil for an internal combustion engine, the ignition coil being able to ensure insulation properties without difficulties in attaching or detaching a spark plug to or from a plug cap.

REFERENCE SIGNS LIST

1 ignition coil
2 coil body part
3 conducting member
4 joint part
5 plug cap
6 close-contact part
61 tip end-side close-contact part
62 base end-side close-contact part
7 strong strained force part
8 spark plug
81 insulator
82 insulator head
X axial direction

The invention claimed is:

1. An ignition coil for an internal combustion engine and configured to receive a spark plug that has an insulator including an insulator head that has no corrugation, the ignition coil comprising a coil body part configured to generate a voltage sufficient to generate a spark, and a joint part, which holds therein an electrical conductor electrically connected to the coil body part and configured to electrically connect to the spark plug, wherein the joint part has a plug cap into which the insulator head of the spark plug is configured to be inserted and which is formed of an elastic member having a cylindrical shape, the plug cap has a close-contact part with an inner peripheral surface that is configured to be closely brought into contact with an outer peripheral surface of the insulator, the close-contact part has a tip end-side close-contact part positioned at a tip end side with respect to a middle position in an axial direction, and a base end-side close-contact part positioned at a base end side with respect to the middle position, at least part of the base end-side close-contact part is provided with a strong strain force part that is configured to generate a strain force for fastening the insulator head, the strain force for fastening the insulator head being stronger than a strain force of all portions of the tip end-side close-contact part, the tip end-side close-contact part has an internal diameter that is constant in the axial direction, the close-contact part is configured to closely contact the outer peripheral surface of the insulator from a base end of the base end-side close-contact part to a tip end of the tip end-side close-contact part, the strong strain force part includes an inner peripheral surface of the plug cap that is swelled inward so that a thickness thereof in a radial direction is larger than that of the tip end-side close-contact part when spark plug is not received in the ignition coil, and an internal diameter of the close-contact part is constant along an axial direction.

* * * * *